US008470756B2

(12) United States Patent
O'Brien

(10) Patent No.: US 8,470,756 B2
(45) Date of Patent: Jun. 25, 2013

(54) ECO-FRIENDLY LAUNDRY PRETREATMENT COMPOSITIONS

(75) Inventor: Jeanne A. O'Brien, Racine, WI (US)

(73) Assignee: S.C. Johnson & Son, Inc., Racine, WI (US)

( * ) Notice: Subject to any disclaimer, the term of this patent is extended or adjusted under 35 U.S.C. 154(b) by 312 days.

(21) Appl. No.: 12/405,862

(22) Filed: Mar. 17, 2009

(65) Prior Publication Data

US 2010/0144580 A1 Jun. 10, 2010

(51) Int. Cl.
*C11D 3/37* (2006.01)

(52) U.S. Cl.
USPC ..... 510/276; 8/137; 8/115.51; 8/115.54; 8/116.1

(58) Field of Classification Search
USPC ..... 510/276
See application file for complete search history.

(56) References Cited

U.S. PATENT DOCUMENTS

| | | | |
|---|---|---|---|
| 5,776,882 | A | 7/1998 | Vasudevan |
| 5,798,327 | A | 8/1998 | Casteleijn et al. |
| 5,833,719 | A | 11/1998 | Francois et al. |
| 5,856,451 | A | 1/1999 | Olsen et al. |
| 5,858,957 | A | 1/1999 | Donoghue et al. |
| 5,880,076 | A | 3/1999 | Vermeer |
| 5,962,398 | A | 10/1999 | Vasudevan |
| 5,981,459 | A | 11/1999 | Verbiest et al. |
| 5,981,718 | A | 11/1999 | Olsen et al. |
| 6,060,441 | A | 5/2000 | Hessel et al. |
| 6,090,762 | A | 7/2000 | Clapperton et al. |
| 6,114,509 | A | 9/2000 | Olsen et al. |
| 6,136,769 | A | 10/2000 | Asano et al. |
| 6,177,396 | B1 | 1/2001 | Clapperton et al. |
| 6,201,110 | B1 | 3/2001 | Olsen et al. |
| 6,288,022 | B1 | 9/2001 | Clark et al. |
| 6,306,805 | B1 | 10/2001 | Bratescu et al. |
| 6,479,452 | B2 | 11/2002 | Weuthen et al. |
| 6,506,220 | B2 | 1/2003 | Clark et al. |
| 6,551,977 | B2 | 4/2003 | Hage et al. |
| 6,586,383 | B2 | 7/2003 | Hage et al. |
| 6,664,429 | B1 | 12/2003 | Huebner et al. |
| 6,686,164 | B1 | 2/2004 | Olsen et al. |
| 6,723,867 | B1 | 4/2004 | Huebner et al. |
| 6,727,212 | B2 | 4/2004 | Kasturi et al. |
| 6,846,796 | B2 | 1/2005 | Schmid |
| 6,926,745 | B2 | 8/2005 | Scheuing et al. |
| 6,995,127 | B1 | 2/2006 | Smith et al. |
| 7,077,870 | B2 | 7/2006 | Findlay et al. |
| 7,250,174 | B2 | 7/2007 | Lee et al. |
| 7,452,917 | B2 | 11/2008 | Baumoeller et al. |
| 7,608,573 | B1 | 10/2009 | Scheuing et al. |
| 7,618,931 | B1 | 11/2009 | Scheuing et al. |
| 2002/0028755 | A1 * | 3/2002 | Van Dijk et al. ..... 510/392 |
| 2003/0013629 | A1 | 1/2003 | Kischkel et al. |
| 2003/0027736 | A1 | 2/2003 | Raths et al. |
| 2003/0122101 | A1 | 7/2003 | Prozzo et al. |
| 2006/0053566 | A1 | 3/2006 | Prozzo et al. |
| 2006/0105937 | A1 | 5/2006 | Duran |
| 2007/0010416 | A1 | 1/2007 | Wu et al. |
| 2007/0179074 | A1 | 8/2007 | Souter et al. |
| 2007/0196898 | A1 | 8/2007 | Nielsen et al. |
| 2007/0275021 | A1 | 11/2007 | Lee et al. |
| 2008/0000032 | A1 | 1/2008 | Wieprecht et al. |
| 2008/0171683 | A1 | 7/2008 | Johnson et al. |
| 2008/0187958 | A1 | 8/2008 | Nielsen et al. |
| 2008/0194453 | A1 | 8/2008 | Lang |
| 2009/0054294 | A1 | 2/2009 | Theiler |

FOREIGN PATENT DOCUMENTS

| | | | |
|---|---|---|---|
| EP | 1 910 506 | | 7/2006 |
| WO | WO9319150 | A1 | 9/1993 |
| WO | WO9743377 | A1 | 11/1997 |
| WO | WO9747716 | A2 | 12/1997 |
| WO | WO9902634 | A1 | 1/1999 |
| WO | WO 2009/017660 | | 2/2009 |
| WO | WO2009024747 | A2 | 2/2009 |

OTHER PUBLICATIONS

Morris, T.C., et al. "Formulating Liquid Detergents for Multiple Enzyme Stability" Happi Household and Personal Products Industry, Rodman Publishing, Ramsey, NJ, USA vol. 41, No. 1 Jan. 1, 2004 pp. 92, 94, 6-98, XP001185775 ISSN: 0090-8878 tables 3,5.

International Search Report and Written Opinion for PCT/US2010/000798 dated Jun. 16, 2010.

* cited by examiner

*Primary Examiner* — Harold Pyon
*Assistant Examiner* — Katie L Hammer

(57) ABSTRACT

An eco-friendly liquid composition for pretreatment of fabrics is disclosed. The composition may include one or more nonionic surfactants, water, and optional ingredients such as a small amount of anionic surfactant, protease enzyme, borax, pH adjusting agent, fragrance, and preservative. The one or more nonionic surfactants may include alkyl polyglycoside. If nonionic surfactants other than the alkyl polyglycoside are included, at least 60% of the total nonionic surfactant in the composition is alkyl polyglycoside. The composition may have a Natural Index of at least 98% as defined herein. The composition may be essentially free of any propellant and bleach component.

15 Claims, No Drawings

ECO-FRIENDLY LAUNDRY PRETREATMENT COMPOSITIONS

BACKGROUND

1. Technical Field

An eco-friendly liquid composition for treatment of stained fabric is disclosed. The composition may include a sugar-based nonionic surfactant such as alkyl polyglycoside, water, and optional ingredients such as a small amount of anionic surfactant, detersive enzyme, boron compound, fragrance, pH adjusting agent, and preservative. The composition may be essentially free of alcoholic solvents, propellant, bleach, bleach precursor and bleach catalyst. At least 60% of the total surfactant included in the composition may be the alkyl polyglycoside.

2. Description of the Related Art

Conventional laundering processes using automatic washing machines are known in the art. Those processes, when using commercial detergents, are generally effective in removing everyday stains from laundry items but are sometimes insufficient to remove tough stains such as motor oil, blood, coffee, ink, dirt, grass, lard, etc. In order to effectively remove such tough stains, it is desirable to pre-treat (or pre-spot) the stains before the laundry items are washed. Pretreatment compositions are typically delivered to the stain and the formulation-treated stain is rubbed or scrubbed so that the stain is loosened, dislodged, or dissolved. Thereafter, the treated stain is effectively removed by a conventional laundering process.

Typical laundry pretreatment compositions for removing tough stains generally contain considerable amounts of oxidant and/or bleach components. The bleach component may be ozone, hypochlorides, halogen oxides, peroxides or other conventional bleaching agents. The bleaching component may also be a bleach catalyst that facilitates oxidation reactions by involving oxygen in the air. One problem associated with bleaching components is that they may not be compatible with other essential ingredients of the composition. Further, the bleach component may also cause discoloration of delicate fabrics if not timely rinsed with water. Therefore, bleach components may need to be excluded in some pretreatment compositions.

In recent years, there has been a significant amount of global consumer awareness in "green", i.e. eco-friendly, household or personal care products. As a result, increasing efforts have been directed to the development of cleaning compositions with desirable ecological profiles. For example, products containing ingredients that are derived from natural and renewable sources, as well as products that are biodegradable in natural environments, have been the focus of this global "eco-friendly" trend.

As most household cleaning compositions contain one or more surfactants to improve its detergency and/or solubilize other ingredients of the composition, eco-friendly surfactants have been developed. In particular, sugar-based nonionic surfactants, such as alkyl polyglycosides, have been used in household cleaning products. Those surfactants are generally obtained from renewable plant-derived raw materials, such as coconut oil and starch, and offer good detergent performance when included in a cleaning composition. Moreover, alkyl polyglycosides are generally considered mild to human skin and pose little, if any, risk to human health or the environment.

One polyglycoside-containing hard surface cleaning composition includes 0.001-2% protease enzyme and 3-10% nonionic surfactant, such as alkyl polyglycoside. The composition also includes up to 3% borax in the composition as enzyme stabilizer, as well as 1-30% citric acid or sodium citrate as a builder. The composition may further include 5-40% anionic surfactant, such as alkyl sulfates, alkyl ether sulfates, or alkyl ester sulfonates. However, unlike the alkyl polyglycosides discussed above, the anionic surfactants generally are not prepared from raw materials derived from natural plants. Furthermore, this cleaning composition does not include any preservative and is not purported to pretreat fabrics before washing.

One polyglycoside-based detergent composition includes 1-55% nonionic surfactant such as alkyl polyglycoside, 0.001-5% protease enzyme, and 0-3% borax. However, the composition also contains 0.25-5% alkoxylated quaternary ammonium ("AQA") cationic surfactant, which is not prepared from raw materials derived from natural, renewable sources. Moreover, the composition is added directly to a washing machine or dishwasher, rather than being used for pretreatment of tough stains on soft or hard surfaces.

In some cleaning compositions, alkyl polyglycoside may be blended with other nonionic surfactants derived non-natural, non-renewable sources. For example, a composition with enhanced enzyme activity may include a surfactant blend of an alkyl ether sulfonate, a linear alcohol ethoxylate, and an alkyl polyglycoside, such as Glucopon® 600UP, wherein the amount of polyglycoside in the surfactant blend ranges from 33% to 50%. The composition may also contain 0.1-10% protease enzyme and 2.14% sodium borate (borax) as an enzyme stabilizer. However, neither the alkyl ether sulfonate nor the linear alcohol ethoxylate is prepared from raw materials derived from renewable plant sources.

Finally, alkyl polyglycoside has been used in a hard surface cleaning and bleaching composition containing peroxide and a bleach catalyst. The cleaning composition may also contain 0.5-15% alkyl polyglycoside, 0.1-1.2% protease enzyme, 0-3% borax, and citric acid and sodium hydroxide as pH adjusting agent. The cleaning formulation does not include any preservative, presumably because of the presence of the peroxide rendering the use of preservatives unnecessary. As discussed above, this composition may not be suitable for pretreatment of fabric stains because the bleach component may cause discoloration and/or other adverse effects to the fabric.

Hence, there is a need for an eco-friendly liquid laundry pretreatment composition. Moreover, there is a need for a pretreatment composition that contains a nonionic surfactant prepared from raw materials derived from natural renewable plant sources. Finally, there is a need for an aqueous, eco-friendly pretreatment composition that performs comparably to existing pretreatment compositions.

SUMMARY OF THE DISCLOSURE

In satisfaction of the aforementioned needs, an eco-friendly liquid composition for pretreatment of stained fabric is disclosed. The composition may include one or more sugar-based nonionic surfactants, water, and optional ingredients such as a small amount of anionic surfactant, protease enzyme, borax, pH adjusting agent, fragrance, and preservative. The one or more nonionic surfactants may include alkyl polyglycoside.

The disclosed pre-treatment compositions may be characterized as having a "Natural Index" (NI) of at least 98%. NI refers to the weight percentage of the composition that includes ingredients that are either directly obtainable from natural sources or made from immediate predecessors that are directly obtainable from natural sources.

The sugar-based surfactant may be prepared from raw materials obtainable from natural plants. In one embodiment, the nonionic surfactant may include one or more alkyl polyglycosides, such as those prepared from coconut oil and starch. The alkyl polyglycosides may be included in the disclosed pretreatment composition at a concentration of from about 0.1 wt % to about 9 wt %.

In addition to the alkyl polyglycoside, the disclosed composition may include other nonionic surfactants, such as those ordinarily used in detergent compositions. To maintain a desirable ecological profile, the alkyl polyglycoside makes up for more than 60% of the total surfactants included in the pretreatment composition.

To formulate a stable composition, the alkyl polyglycoside may be solubilized by an anionic surfactant. In one embodiment, the anionic surfactant may be sodium alkyl sulfate. In another embodiment, the anionic surfactant may be a sodium alkyl benzensulfonate. In order to maintain a desirable ecological profile, the disclosed composition may include only a small amount of anionic surfactant enough to solubilize the alkyl polyglycoside. In one embodiment, the anionic surfactant is included in the composition at a concentration of from about 0.1 wt % to about 3 wt %.

The composition may also include a detersive enzyme component to improve the cleaning performance thereof by breaking down proteins, fats, or carbohydrates in tough stains. In one embodiment, the detersive enzyme may include a protease enzyme. Other detersive enzymes known in the art may be used to substitute or supplement the protease enzyme.

The composition may further include boron compound as a detergent booster to improve the cleaning performance of the composition and/or as a buffer to help maintaining a desirable pH range. The boron compound may also help stabilizing the enzyme component of the composition. In one embodiment, the composition may include from about 0.1 wt % to about 2 wt % borax although other suitable concentrations may also be used.

The composition may also include one or more acid and/or base components in order to maintain a desirable pH range, to further facilitate stain removal, and/or to stabilize the enzyme components. In one embodiment, the acid may be citric acid and the base may be sodium hydroxide.

The composition may optionally include a fragrance to enhance ambience when the composition is applied to the stained fabric. In particular, when the stained fabric has a malodor associated with it, the fragrance may help to mask the odor. The type, tone, and concentration of the fragrance would be obvious to one of ordinary skill in the art. In one embodiment, the composition may include up to about 1.0 wt % fragrance.

Finally, the composition may include a preservative to inhibit microorganism formation. In particular, the preservative may prevent the biological degradation of the sugar-based surfactant. The type and concentration of the suitable preservative would be obvious to one of ordinary skill in the art in view of this disclosure.

To avoid discoloration and other undesirable damages to the treated fabric, the pretreatment composition may be essentially free of any bleach components, such as bleaching agents, bleach precursors and bleach catalysts. Moreover, the pretreatment composition may also be essentially free of any alcoholic solvents, propellant, and cationic surfactants.

Other advantages and features of the disclosed methods and compositions will be described in greater detail below. It will also be noted here and elsewhere that the pretreatment composition disclosed herein may be suitably modified to be used in a wide variety of cleaning operations, such as on-the-go treatment of stained fabrics, by one of ordinary skill in the art without undue experimentation.

DETAILED DESCRIPTION OF THE PRESENTLY PREFERRED EMBODIMENTS

This disclosure is generally related to an eco-friendly liquid composition for pretreatment of stained fabric. To evaluate the ecological profile of the disclosed pretreatment composition, the term "Natural Index" (NI) is used herein to refer to the weight percentage of the composition that includes ingredients that are either directly obtainable from natural sources or made from immediate predecessors that are directly obtainable from natural sources. For example, ingredients such as water, borax, enzymes (not including their carriers), and citric acid are all obtainable from natural sources while synthetic fragrances are not. Similarly, while the alkyl polyglycosides disclosed herein may be made from immediate predecessors (fatty alcohol and glucose) that are obtainable from natural sources, other surfactants, such as ethoxylated nonionic surfactants, alkyl sulfate or alkylbenzene sulfonate anionic surfactants, and quaternary ammonium cationic surfactant, are based on petroleum chemicals and thus do not count toward the NI of the composition.

In general, the composition may include one or more nonionic sugar surfactants, water, and optional ingredients such as a small amount of anionic surfactant, detersive enzyme, borax, pH adjusting agent, fragrance, and preservatives. The one or more nonionic surfactants may include alkyl polyglycoside.

In some embodiments, the disclosed composition may include from about 0.1 to about 9 wt % alkyl polyglycoside nonionic surfactant and water, wherein the composition has a NI of at least 98%. The composition may also optionally include a small amount of anionic surfactant, detersive enzyme, and borax. The composition may be essentially free of propellant and bleach component, such as bleach, bleach precursor, or bleach catalyst. In one embodiment, the polyglycoside makes up for more than 60% of the total surfactant included in the composition.

Non-Ionic Surfactant

The nonionic surfactant used in the disclosed composition may include a sugar-based surfactant prepared from raw materials obtained from natural plants. In one embodiment, the nonionic surfactant may include one or more alkyl polyglycosides, such as those prepared from coconut oil and starch. The alkyl polyglycosides may be included in the disclosed pretreatment composition at a concentration of from about 0.1 wt % to about 9 wt %.

The alkyl polyglycosides which can be used in the cleaning compositions according to the invention correspond to the following formula I:

$$R_1O(R_2O)_b(Z)_a$$

wherein $R_1$ is a monovalent organic radical having from about 6 to about 30 carbon atoms; $R_2$ is a divalent alkylene radical having from 2 to 4 carbon atoms; Z is a saccharide residue having 5 or 6 carbon atoms; b is a number having a value from 0 to about 12; a is a number having a value from 1 to about 6. In one embodiment, the alkyl polyglycoside included in the disclosed composition according to the invention have the formula I wherein Z is a glucose residue and b is zero. Such alkyl polyglycosides are commercially available, for example, as APG®, GLUCOPON®, or PLANTAREN® surfactants from Cognis, 5051 Estecreek Drive, Cincinnati, Ohio 45232.

In one embodiment, the nonionic sugar surfactant is an alkyl polyglycoside corresponding to formula I wherein $R_1$ is a monovalent organic radical having from about 8 to about 16 carbon atoms, b is zero, and a is a number having a value of from 1 to about 3. Suitable alkyl polyglycoside includes Glucopon® 425 N and Glucopon® 600 UP, both of which are readily biodegradable and made from glucose derived from corn and fatty alcohols derived from coconut and palm kernel oils.

In addition to the alkyl polyglycoside, the disclosed composition may include other sugar-based nonionic surfactants, such as polyhydroxy fatty acid amides ("glucamides"). To maintain a desirable ecological profile, the sugar-based nonionic surfactant makes up for at least more than 60% of the total surfactants included in the pretreatment composition. In one embodiment, the composition contains less than 1 wt %, and more preferably less than 0.5 wt % of nonionic surfactants that do not count toward the Natural Index of the composition. In one embodiment, the sugar-based nonionic surfactant is the only nonionic surfactant included in the composition.

Anionic Surfactant

To formulate a stable composition, the alkyl polyglycoside may be solubilized by an anionic surfactant. In one embodiment, the anionic surfactant may be sodium alkyl sulfate. In another embodiment, the anionic surfactant may be a sodium alkyl benzensulfonate. In order to maintain a desirable ecological profile, the disclosed composition may only include a small amount of anionic surfactant enough to solubilize the alkyl polyglycoside. In one embodiment, the anionic surfactant is included in the composition at a concentration of from about 0.1 wt % to about 3 wt %.

In one embodiment, the anionic surfactant included in the disclosed composition includes sodium, potassium or ammonium salts of alkyl benzene sulfonates in which the alkyl group contains from about 8 to about 18 carbon atoms in branched or straight chain configuration. Non-limiting examples of alkyl benzene sulfonates include sodium dodecyl benzene sulfonate, potassium dodecyl benzene sulfonate, ammonium dodecyl benzene sulfonate, sodium $C_{11}$-$C_{13}$ alkyl benzene sulfonate, sodium tetra-decyl benzene sulfonate, ammonium tetradecyl benzene sulfonate and mixtures thereof. Other alkylbenzene sulfonate known in the art may also be used in the disclosed composition. In one embodiment, the anionic surfactant includes sodium alkylbenzene sulfonate sold under the trade name Bio-soft® D-40 by the Stepan Company, 22 W Frontage Rd., Northfield, Ill. 60093.

In another embodiment, anionic surfactant included in the disclosed composition includes sodium, potassium and ammonium salts of alkyl sulfates, especially those obtained by sulfating higher $C_8$-$C_{18}$ alkyl alcohols produced naturally from coconut oil or those prepared synthetically from petroleum sources. Non-limiting examples of alkyl sulfates useful in the present invention include sodium dodecyl sulfate, potassium dodecyl sulfate, ammonium dodecyl sulfate, monoethanolammonium dodecyl sulfate, diethanolammonium dodecyl sulfate, triethanolammonium dodecyl sulfate, sodium tetradecyl sulfate, potassium tetradecyl sulfate, ammonium tetradecyl sulfate, monoethanolammonium tetradecyl sulfate, triethanolammonium tetradecyl sulfate, sodium hexadecyl sulfate, ammonium hexadecyl sulfate, sodium coconut sulfate, sodium $C_{12}$-$C_{15}$ alkyl sulfate and mixtures thereof. In one embodiment, the anionic surfactant includes sodium lauryl sulfate sold under the trade name Stepanol® WA-Extra by the Stepan Company, 22 W Frontage Rd., Northfield, Ill. 60093.

Other suitable anionic surfactant for use in the disclosed composition include sodium, potassium and ammonium salts of alkyl ether sulfates which are obtained by sulfating the higher $C_8$-$C_{18}$ alcohol ethoxylates. Non-limiting examples of alkyl ether sulfates suitable for use in the disclosed composition may include sodium laureth-1 sulfate, sodium laureth-2 sulfate, sodium laureth-3 sulfate, potassium laureth-1 sulfate, potassium laureth-2 sulfate, potassium laureth-3 sulfate, ammonium laureth-1 sulfate, ammonium laureth-2 sulfate, ammonium laureth-3 sulfate, monoethanolammonium laureth-1 sulfate, monoethanolammonium laureth-2 sulfate, monoethanolammonium laureth-3 sulfate, diethanolammonium laureth-1 sulfate, diethanolammonium laureth-2 sulfate, diethanolammonium laureth-3 sulfate, triethanolammonium laureth-1 sulfate, triethanolammonium laureth-2 sulfate, triethanolammonium laureth-3 sulfate, sodium myreth-1 sulfate, sodium myreth-2 sulfate, sodium myreth-3-sulfate, ammonium myreth-1 sulfate, ammonium myreth-2 sulfate, ammonium myreth-3 sulfate, etc.

Detersive Enzyme

The composition may also include one or more detersive enzyme to improve the cleaning performance thereof by breaking down proteins, fats, or carbohydrates in tough stains. Suitable detersive enzymes may include proteases, amylases, lipases, cellulases, or mixtures thereof.

Detersive enzymes may be optionally incorporated at suitable levels known in the art. In one embodiment, the disclosed composition includes from about 0.001 wt % to about 2 wt % of active protease enzyme. In another embodiment, the disclosed composition includes from about 0.01 wt % to about 1 wt % of active protease enzyme. The concentrations and types of protease enzyme disclosed herein should not be considered as limiting the scope of this disclosure.

Suitable protease enzymes for use in the cleaning composition of the present invention are of vegetable, animal, bacterial, mold and fungal origin. Non-limiting examples of proteases enzyme suitable for use in the disclosed composition include the subtilisins obtained from particular strains of *B. subtilis* and *B. licheniforms*. Another suitable protease is obtained from a strain of *Bacillus*, having maximum activity throughout the pH range of 8-12, developed and sold by Novo Industries A/S under the registered trade name ESPERASE®. Other suitable protease enzymes suitable for removing protein-based stains that are commercially available include those sold under the trade names ALCALASE® and SAVINASE® by Novo Industries A/S and MAXATASE® by International Bio-Synthetics, Inc.

The cellulase usable in the present invention include both bacterial or fungal cellulase. Preferably, they will have a pH optimum of between 5 and 9.5. Examples include cellulases produced by a strain of *Humicola insolens* (*Humicola grisea* var. *thermoidea*), particularly the *Humicola* strain DSM 1800, and cellulases produced by a fungus of *Bacillus* N or a cellulase 212-producing fungus belonging to the genus *Aeromonas*, and cellulase extracted from the hepatopancreas of a marine mollusc (*Dolabella Auricula Solander*).

Amylases suitable for use in the present cleaning composition include, for example, .alpha.-amylases obtained from a special strain of *B. licheniforms*. Amylolitic proteins include, for example, RAPIDASE®, available from International Bio-Synthetics, Inc. and TERMAMYL®, available from Novo Industries.

Examples of suitable lipases for use herein include those of animal, plant, and microbiological origin. Although only limited studies on lipase distribution in plants have been conducted, suitable lipase enzymes are present in cambium, bark, and in plant roots. In addition, lipases have been found in the seeds of fruit, oil palm, lettuce, rice, bran, barley and malt, wheat, oats and oat flour, cotton tung kernels, corn, millet, coconuts, walnuts, *fusarium, cannabis* and cucurbit. The lipase may be enzyme derived from *Humicola lanuginosa* and commercially available from Novo Enzyme under the trade name LIPOLASE®.

Boron Compound

The composition may further include one or more boron compound as a detergent booster to improve the cleaning performance of the composition and/or as a buffer to help maintaining a desirable pH range. The boron compound may also help stabilizing the enzyme component of the composition. In one embodiment, the composition may include from about 0.1 wt % to about 2 wt % of the boron compound although other suitable concentrations may also be used.

The boron compound used in the disclosed composition may include alkali metal borates (e.g., sodium ortho-, meta- and pyroborate and sodium pentaborate), boric acid, boric oxide, and other suitable boron-containing chemicals used in detergent composition. Substituted boric acids (e.g., phenylboronic acid, butane boronic acid and a p-bromo phenylboronic acid) can also be used in place of boric acid. In one embodiment, the boron compound is borax and is included in the disclosed composition at a concentration of from about 0.1 wt % to about 2 wt %.

The composition may also optionally include one or more pH adjusting agents, such as acid and/or base components in order to maintain a desirable pH range, to further facilitate stain removal, and/or to stabilize the enzyme components. The acid or base component may be either organic or inorganic. In one embodiment, the acid may be citric acid included in the composition at a concentration of from about 0.1 wt % to about 2 wt %. In another embodiment, the base may be sodium hydroxide included in the composition at a concentration of from about 0.1 wt % to about 1 wt %.

In order to prevent degradation cause by microorganism, the composition may optionally include one or more preservatives. In particular, the preservative may prevent the biological degradation of the sugar-based surfactant. Suitable preservatives for use in the disclosed composition include, but are not limited to, Bioban™ CS-1135 marketed by Dow, Neolone™ M-10 and Kathon™ CG-ICP marketed by Rohm & Haas, and Proxel® GXL marketed by Arch Chemicals. The preservative may be included in the disclosed composition at a concentration of from about 0.1 wt % to about 1 wt %. It is to be understood that the type and concentration of the preservative disclosed above should not be considered as limiting the scope of this disclosure. Other suitable preservative may be used in the disclosed composition without undue experimentation in view of this disclosure.

The composition may optionally include a fragrance to enhance ambience when the composition is applied to the stained fabric. In particular, when the stained fabric has a malodor associated with it, the fragrance may help to mask the odor. The type, tone, and concentration of the fragrance would be obvious to one of ordinary skill in the art. In one embodiment, the composition may include up to about 1.0 wt % fragrance. The fragrances may include natural and/or synthetic ingredients.

The disclosed liquid composition may include water as a solvent. In one embodiment, the composition includes at least 80 wt %, more preferably at least 85 wt %, and most preferably at least 87 wt % water. To avoid discoloration and other undesirable damages to the treated fabric, the pretreatment composition may be essentially free of any bleach components, such as bleaching agents, bleach precursors and bleach catalysts. Moreover, the pretreatment composition may also be essentially free of any alcoholic solvents, propellant, and cationic surfactants.

Eight exemplary compositions are disclosed below. It should be noted that this disclosure is not limited to the particular compositions and acceptable ranges of the various ingredients are also set forth below.

FORMULATION I

| Function/ Description | Chemical Name/Trade Name | wt % | Natural Index (NI) (%) |
|---|---|---|---|
| Solvent | Deionized water | 88.05 | 88.05 |
| Nonionic Surfactant | C8-C16 alkyl polyglycoside/ Glucopon ® 425N (50% active) | 8.00 | 8.00 |
| Enzyme | Protease Enzyme (47% active) | 0.20 | 0.094 |
| pH adjusting agent/ cleaning agent/ enzyme stabilizer | Citric acid 50% (aq) | 2.00 | 2.00 |
| pH adjusting agent/ cleaning agent/ enzyme stabilizer | Sodium hydroxide 50% (aq) | 0.90 | 0.45 |
| Buffer/cleaning agent | Borax, 5 Mols | 0.50 | 0.50 |
| Fragrance | Fragrance | 0.20 | 0.00 |
| Preservative | Bioban ™ CS-1135 | 0.20 | 0.00 |
| | | 100.00 | 99.094 |

FORMULATION II

| Function/Description | Chemical Name/Trade Name | wt % | Natural Index (NI) (%) |
|---|---|---|---|
| Solvent | Deionized water | 89.70 | 89.70 |
| Nonionic surfactant | C10-C16 alkyl polyglycoside/ Glucopon ® 600UP (50% active) | 7.00 | 7.00 |
| Anionic surfactant | Sodium lauryl sulfate/ Stepanol ® WA-Extra (29% active) | 0.80 | 0.568 |
| Enzyme | Protease enzyme (47% active) | 0.20 | 0.094 |
| pH adjusting agent/ cleaning agent/enzyme stabilizer | Citric acid 50% | 1.00 | 1.00 |
| pH adjusting agent/ cleaning agent/enzyme stabilizer | Sodium hydroxide 50% | 0.45 | 0.225 |
| Buffer/cleaning agent | Borax, 5 Mols | 0.50 | 0.50 |
| Fragrance | Fragrance | 0.20 | 0.00 |
| Preservative | Neolone ™ M-10 | 0.15 | 0.00 |
| | | 100.00 | 99.087 |

FORMULATION III

| Function/Description | Chemical Name/Trade Name | wt % | Natural Index (NI) (%) |
|---|---|---|---|
| Solvent | Deionized water | 89.70 | 89.70 |
| Nonionic surfactant | C10-C16 alkyl polyglycoside/ Glucopon ® 600UP (50% active) | 7.00 | 7.00 |

-continued

FORMULATION III

| Function/Description | Chemical Name/Trade Name | wt % | Natural Index (NI) (%) |
|---|---|---|---|
| Anionic surfactant | Sodium alkylbenzene sulfonate/Bio-soft ® D-40 (38% active) | 0.75 | 0.465 |
| Enzyme | Protease enzyme (47% active) | 0.20 | 0.094 |
| pH adjusting agent/ cleaning agent/enzyme stabilizer | Citric acid 50% | 1.00 | 1.00 |
| pH adjusting agent/ cleaning agent/enzyme stabilizer | Sodium hydroxide 50% | 0.45 | 0.225 |
| Buffer/cleaning agent | Borax, 5 Mols | 0.50 | 0.50 |
| Fragrance | Fragrance | 0.20 | 0.00 |
| Preservative | Proxel ® GXL | 0.05 | 0.00 |
| Preservative | Kathon ™ CG-ICP | 0.03 | 0.00 |
| | | 100.00 | 98.984 |

FORMULATION IV

| Function/Description | Chemical Name/Trade Name | wt % | Natural Index (NI) (%) |
|---|---|---|---|
| Solvent | Deionized water | 90.60 | 90.60 |
| Nonionic surfactant | C10-C16 alkyl polyglycoside/ Glucopon ® 600UP (50% active) | 6.00 | 6.00 |
| Anionic surfactant | Sodium alkylbenzene sulfonate/Bio-soft ® D-40 (38% active) | 0.90 | 0.558 |
| Enzyme | Protease enzyme (47% active) | 0.20 | 0.094 |
| pH adjusting agent/ cleaning agent/enzyme stabilizer | Citric acid 50% | 1.00 | 1.00 |
| pH adjusting agent/ cleaning agent/enzyme stabilizer | Sodium hydroxide 50% | 0.45 | 0.225 |
| Buffer/cleaning agent | Borax, 5 Mols | 0.50 | 0.50 |
| Fragrance | Fragrance | 0.20 | 0.00 |
| Preservative | Proxel ® GXL | 0.15 | 0.00 |
| | | 100.00 | 98.977 |

FORMULATION V

| Function/ Description | Chemical Name/Trade Name | wt % | Natural Index (NI) (%) |
|---|---|---|---|
| Solvent | Deionized water | 90.37 | 90.37 |
| Nonionic surfactant | C8-C16 alkyl polyglycoside/ Glucopon ® 425N (50% active) | 6.00 | 6.00 |
| Anionic surfactant | Sodium alkylbenzene sulfonate/ Bio-soft ® D-40 (38% active) | 1.20 | 0.744 |
| Enzyme | Protease enzyme (47% active) | 0.20 | 0.094 |
| pH adjusting agent/ cleaning agent/ enzyme stabilizer | Citric acid 50% | 1.00 | 1.00 |
| pH adjusting agent/ cleaning agent/ enzyme stabilizer | Sodium hydroxide 50% | 0.45 | 0.225 |

-continued

FORMULATION V

| Function/ Description | Chemical Name/Trade Name | wt % | Natural Index (NI) (%) |
|---|---|---|---|
| Buffer/cleaning agent | Borax, 5 Mols | 0.50 | 0.50 |
| Fragrance | Fragrance | 0.20 | 0.00 |
| Preservative | Proxel ® GXL | 0.05 | 0.00 |
| Preservative | Kathon ™ CG-ICP | 0.03 | 0.00 |
| | | 100.00 | 98.958 |

FORMULATION VI

| Function/Description | Chemical Name/Trade Name | wt % | Natural Index (NI) (%) |
|---|---|---|---|
| Solvent | Deionized water | 92.15 | 92.15 |
| Nonionic surfactant | C10-C16 alkyl polyglycoside/ Glucopon ® 600UP (50% active) | 5.00 | 5.00 |
| Anionic surfactant | Sodium lauryl sulfate/Stepanol ® WA-Extra (29% active) | 0.40 | 0.284 |
| Enzyme | Protease enzyme (47% active) | 0.20 | 0.094 |
| pH adjusting agent/ cleaning agent/enzyme stabilizer | Citric acid 50% | 1.00 | 1.00 |
| pH adjusting agent/ cleaning agent/enzyme stabilizer | Sodium hydroxide 50% | 0.50 | 0.25 |
| Buffer/cleaning agent | Borax, 5 Mols | 0.50 | 0.50 |
| Fragrance | Fragrance | 0.10 | 0.00 |
| Preservative | Neolone ™ M-10 | 0.15 | 0.00 |
| | | 100.00 | 99.278 |

FORMULATION VII

| Function/Description | Chemical Name/Trade Name | wt % | Natural Index (NI) (%) |
|---|---|---|---|
| Solvent | Deionized water | 94.17 | 94.17 |
| Nonionic surfactant | C8-C16 alkyl polyglycoside/ Glucopon ® 425N (50% active) | 2.00 | 2.00 |
| Enzyme | Protease enzyme (47% active) | 0.20 | 0.094 |
| pH adjusting agent/ cleaning agent/enzyme stabilizer | Citric acid 50% | 1.00 | 1.00 |
| pH adjusting agent/ cleaning agent/enzyme stabilizer | Sodium hydroxide 50% | 0.45 | 0.225 |
| Buffer/cleaning agent | Borax, 5 Mols | 2.00 | 2.00 |
| Fragrance | Fragrance | 0.10 | 0.00 |
| Preservative | Proxel ® GXL | 0.05 | 0.00 |
| Preservative | Kathon ™ CG-ICP | 0.03 | 0.00 |
| | | 100.00 | 99.489 |

FORMULATION VIII

| Function/Description | Chemical Name/Trade Name | wt % | Natural Index (NI) (%) |
|---|---|---|---|
| Solvent | Deionized water | 90.65 | 90.65 |
| Nonionic surfactant | C8-C16 alkyl polyglycoside/ Glucopon ® 425N (50% active) | 7.00 | 7.00 |
| Buffer/cleaning agent | Borax, 5 Mols | 2.00 | 2.00 |
| Fragrance | Fragrance | 0.20 | 0.00 |
| Preservative | Neolone ™ M-10 | 0.15 | 0.00 |
| | | 100.00 | 99.65 |

As indicated above, the disclosed pretreatment compositions may have an NI of at least 98% with some embodiments having NI's of at least 98.5% or even at least 98.9%.

The pretreatment performance of the disclosed composition may be comparable to that of a commercial pretreatment product, such as Shout® liquid currently marketed by S.C. Johnson & Son of Racine, Wis., USA. One important aspect of the pretreatment performance is the ability to loosen or remove various types of stains from fabric.

To evaluate the pretreatment performance of the disclosed composition, laboratory stain removal testing is conducted using slightly modified protocols and stains outlined in ASTM Method D4265 (1998). For better performance differentiation between tested pretreatment compositions, the stained fabrics are prepared so that the stains are difficult to be removed. Specifically, stains are placed on fabric that is lying flat on a table instead of applying the stain to suspending fabric, as specified in the ASTM Method D4265 (1998). This modification has been deemed satisfactory by the National Advertising Division of the Better Business Bureau.

In particular, a properly-sized swatch of 100% cotton are prepared according to the ASTM D4265 (1998) and stained using the modified staining process discussed above. The stained swatch is allowed to set overnight.

On the following day, the stained swatch is soaked with 2.0 milliliters of the tested pretreatment composition, rubbed with a brush, and allowed to set for five minutes so that the tested composition can loosen or dislodge the stain. Thereafter, the treated swatch is placed into a Whirlpool washing machine with 4 bath towels as ballast and 45 grams of Liquid Tide® 2× detergent. The swatch is then laundered with medium water level (17-19 gallons of water) at 90° F. wash and 60° F. rinse.

After laundering, the swatch is removed from the washing machines, ironed on the reverse side of the stain, and analyzed with a Minolta Colorimeter to generate a ΔE measurement for the swatch, wherein a higher ΔE indicates more stain remaining on the swatch. For each type of stain, the testing is repeated five to ten times with each pretreatment composition so that an average ΔE value can be obtained. The results of the tests are listed in the table below.

TABLE 1

Performance Comparison between Formulation IV and a Commercial Pretreatment Composition

| Stains | Shout ® Liquid (ΔE) | Formula IV (ΔE) |
|---|---|---|
| Used Cooking Oil | 2.27 | 2.82 |
| Butter | 4.09 | 2.09 |

TABLE 1-continued

Performance Comparison between Formulation IV and a Commercial Pretreatment Composition

| Stains | Shout ® Liquid (ΔE) | Formula IV (ΔE) |
|---|---|---|
| Lard | 8.40 | 7.41 |
| Olive Oil | 2.24 | 2.79 |
| Blood (Beef) | 3.12 | 2.95 |
| Coffee | 1.93 | 2.02 |
| Grape Juice | 2.97 | 3.23 |
| Grass Slurry | 3.76 | 4.24 |
| Spaghetti Sauce | 3.22 | 3.50 |

As clearly indicated in Table 1, the disclosed composition outperforms the commercial composition when used to treat certain type of stains (butter, blood, and lard). For some other type of stains (olive oil, grape juice, and grass slurry), however, the performances of the disclosed compositions are less satisfactory than, but still comparable to, that of the commercial composition. More specifically, the disclosed compositions are comparable to the commercial composition because the ΔE of the disclosed composition is no greater than 125% of the ΔE of the commercial composition with respect to the stains tested above.

While only certain embodiments have been set forth, alternative embodiments and various modifications will be apparent from the above descriptions to those skilled in the art. These and other alternatives are considered equivalents and within the spirit and scope of this disclosure.

What is claimed:

1. A composition for treating stained fabric, comprising:
from about 0.1 to 9 wt % alkyl polyglycoside;
from 0.1 to less than 1 wt % anionic surfactant; and
water;
wherein alkyl polyglycoside is more than 80% of the total surfactant in the composition.

2. The composition of claim 1, further comprising from about 0.001 wt % to about 2% wt % detersive enzyme.

3. The composition of claim 2, wherein the detersive enzyme comprises protease enzyme.

4. The composition of claim 1, further comprising from about 0.1 wt % to about 2 wt % boron compound.

5. The composition of claim 4, wherein the boron compound comprises borax.

6. The composition of claim 1, wherein the anionic surfactant is selected from the group consisting of alkyl sulfate, alkylbenzene sulfonate, and mixtures thereof.

7. The composition in claim 1, wherein the composition is essentially free of propellant and bleach component.

8. A composition for treating stained fabric, comprising:
from about 0.1 wt % to 9 wt % alkyl polyglycoside as a nonionic surfactant;
from 0.1 to less than 1 wt % anionic surfactant; and
from about 0.001 wt % to about 2 wt % detersive enzyme;
from about 0.1 wt % to about 2 wt % boron compound; and
water,
wherein alkyl polyglycoside is more than 80% of the total surfactant in the composition.

9. The composition of claim 8, wherein the detersive enzyme comprises protease enzyme.

10. The composition of claim 8, wherein the boron compound comprises borax.

11. The composition of claim 8, wherein the anionic surfactant is selected from the group consisting of alkyl sulfate, alkylbenzene sulfonate, and mixtures thereof.

12. The composition in claim 8, wherein the composition is essentially free of propellant and bleach component.

13. A composition for treating stained fabric, comprising:

from about 0.1 wt % to 9 wt % alkyl polyglycoside;

from 0.1 to less than 1 wt % anionic surfactant;

at least 80 wt % water; and at least one preservative for preventing biodegration of alkyl polyglycoside;

wherein the composition is essentially free of propellant and bleach component, and wherein alkyl polyglycoside is more than 80% of the total surfactant in the composition.

14. The composition of claim 13, further comprising from about 0.001 wt % to about 2 wt % detersive enzyme.

15. The composition of claim 13, further comprising from about 0.1 wt % to about 2 wt % boron compound.

* * * * *